US006819632B1

(12) United States Patent
Paul

(10) Patent No.: US 6,819,632 B1
(45) Date of Patent: Nov. 16, 2004

(54) WRISTWATCH WITH REMOVABLE FACE

(76) Inventor: Gary Paul, P.O. Box 1767, Paramus, NJ (US) 07653

( * ) Notice: Subject to any disclaimer, the term of this patent is extended or adjusted under 35 U.S.C. 154(b) by 0 days.

(21) Appl. No.: 10/625,214

(22) Filed: Jul. 23, 2003

(51) Int. Cl.[7] ..... G04B 37/00; G04B 19/04; A44C 5/00

(52) U.S. Cl. ..... 368/88; 223/228; 223/281; 223/285

(58) Field of Search ..... 368/88, 223, 228, 368/276, 281, 285, 294, 299, 300

(56) References Cited

U.S. PATENT DOCUMENTS

| | | | | |
|---|---|---|---|---|
| 4,660,992 A | | 4/1987 | Paul et al. | |
| 4,796,240 A | | 1/1989 | Stevens | |
| 5,008,869 A | | 4/1991 | Dweck | |
| 5,018,118 A | | 5/1991 | Ross | |
| 5,077,709 A | * | 12/1991 | Feher | 368/229 |
| 5,168,497 A | | 12/1992 | Ozaki et al. | |
| 5,224,078 A | * | 6/1993 | Mallin | 368/223 |
| 5,305,292 A | * | 4/1994 | Reynoso | 368/281 |
| 5,751,667 A | | 5/1998 | Nunes | |
| 5,787,055 A | | 7/1998 | Alpert | |
| 5,793,710 A | | 8/1998 | Jacobi, Jr. | |
| 6,118,735 A | | 9/2000 | Li | |
| 6,416,217 B1 | * | 7/2002 | Von Braunhut | 368/278 |

* cited by examiner

*Primary Examiner*—Vit W. Miska
(74) *Attorney, Agent, or Firm*—Amster, Rothstein & Ebenstein LLP

(57) ABSTRACT

A wristwatch including a casing having top and bottom parts and a movement therein, an upper housing formed as an integral unit, including: top and bottom transparent panels, drive shafts extending through the bottom transparent panel, the drive shafts having top and bottom ends, time indicating hands fixed to the top ends of the drive shafts, and side walls fixed to and maintaining the top and bottom transparent panels spaced apart to define a chamber therein for enclosing the time indicating hands, a replaceable watch face, and coupling elements for releasably securing the upper housing to the top of the casing, with the replaceable watch face situated below the bottom transparent panel of the upper housing and above the top part of the casing, and with the bottom end of the drive shafts releasably coupled to the movement.

24 Claims, 4 Drawing Sheets

FIG. 2
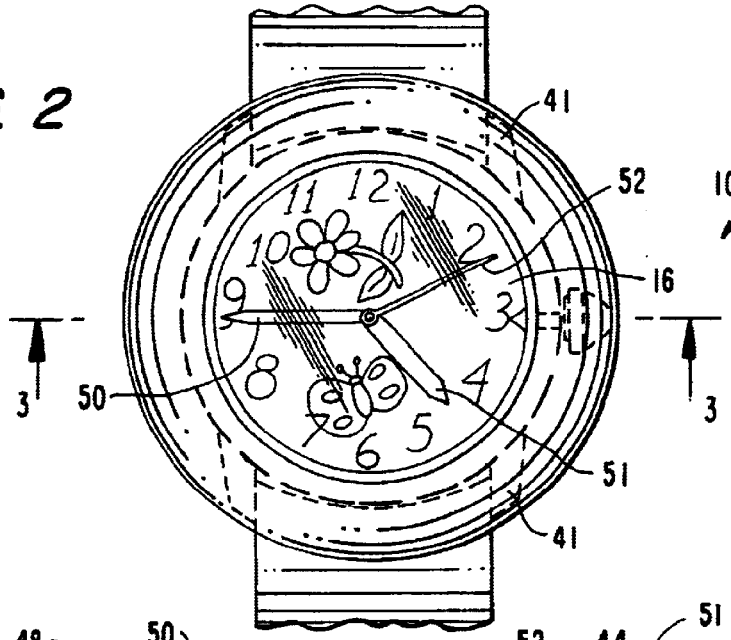
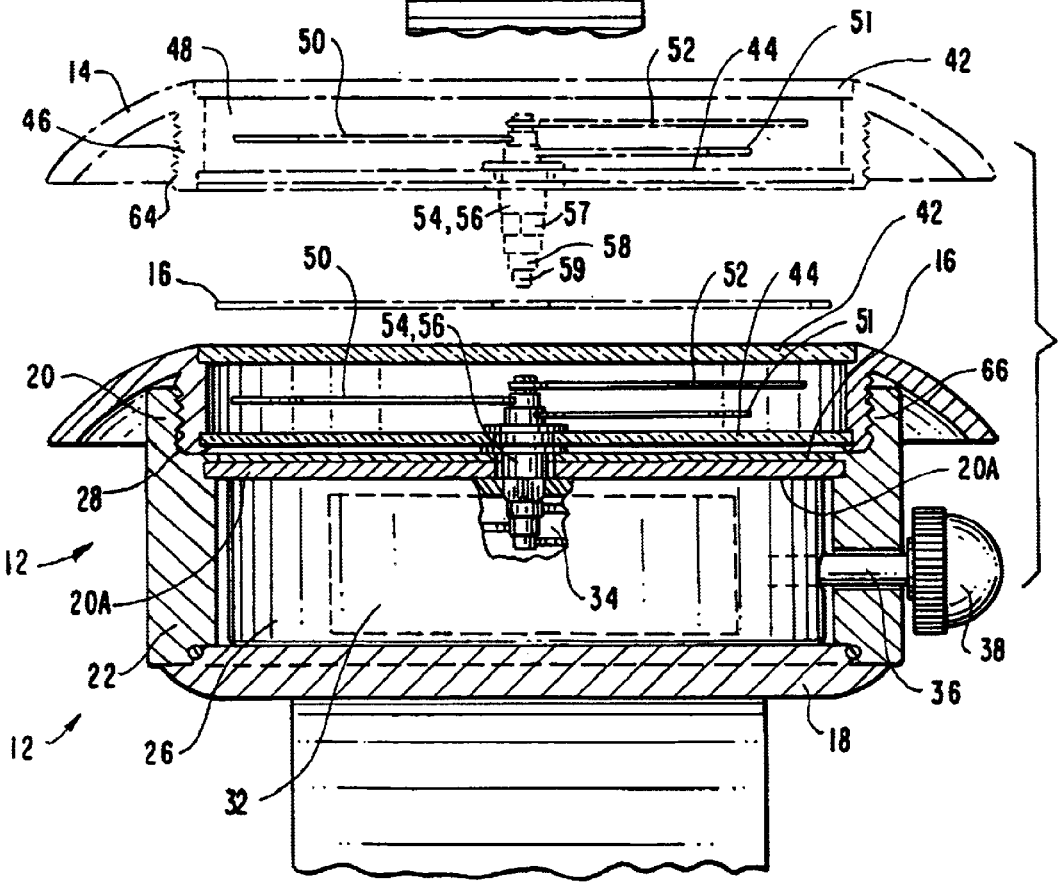
FIG. 3

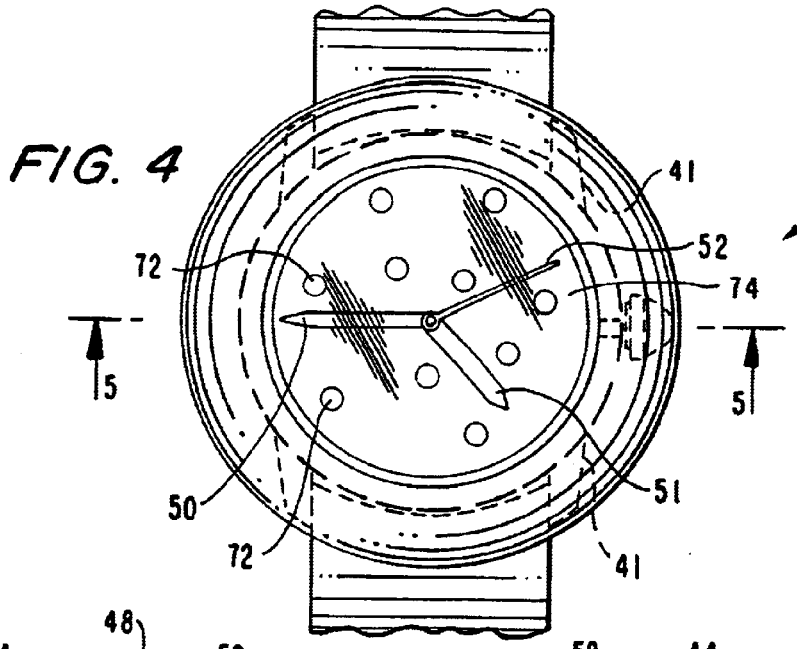
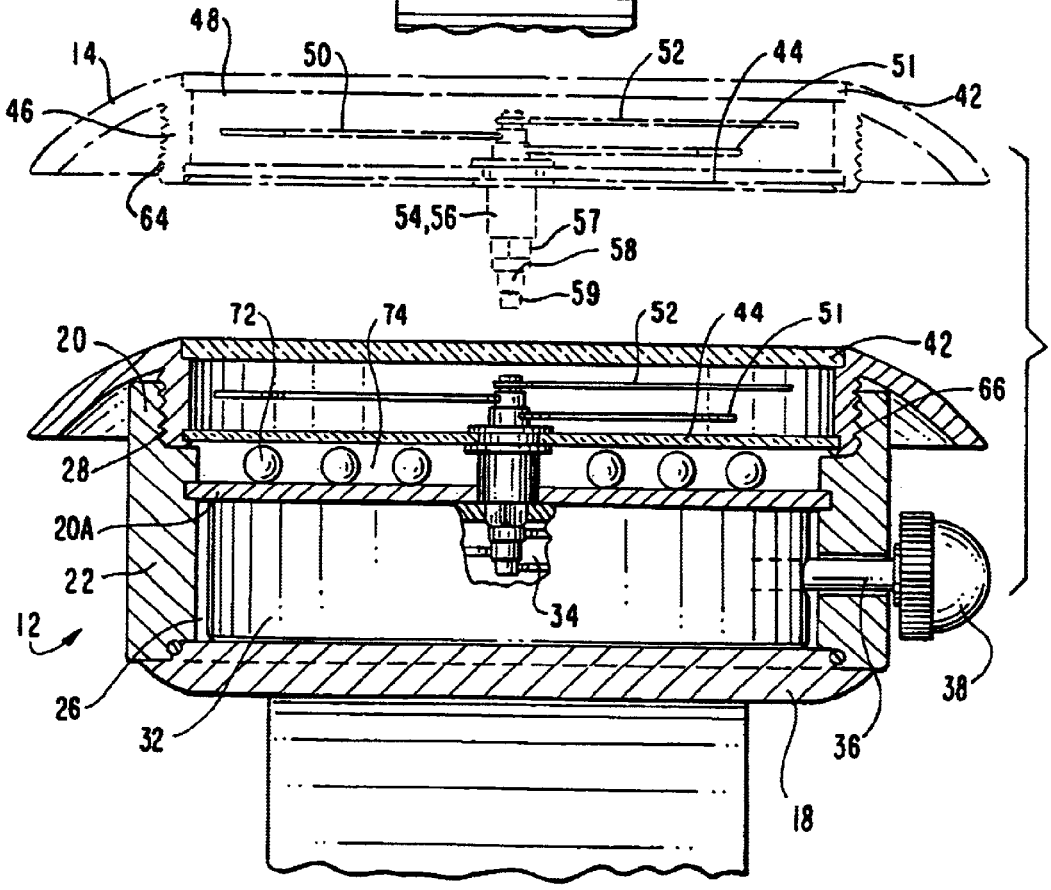
FIG. 5

WRISTWATCH WITH REMOVABLE FACE

BACKGROUND OF THE INVENTION

1. Field of the Invention

This invention is in the field of wristwatches and more particularly wristwatches with removable watch faces.

2. Prior Art

It is known that wristwatches are one of the most commonly used devices in the world, and it is further known that for many persons a wristwatch is not only a timepiece but also is an accessory of dress and even a fashion statement. In the latter regard, it is desirable not only that a wristwatch be highly attractive, but also be one that coordinates or harmonizes with the other articles of dress, such as a person's suit, shirt or jewelry.

While some persons wear the same watch for all occasions and with all different attire, either because they cannot afford additional watches or because the dress coordination issue is not important to them, for others, one particular watch cannot possibly be acceptable for numerous different styles and levels of dress, from casual dress to business dress to formal dress, and furthermore, one watch is not likely to match particularly well with many different outfits within one of these dress categories.

The obvious solution, if one has the means, is to purchase numerous different watches for the different situations. Notwithstanding the differences in watches based on quality and design of the watch movement and of the casing and bracelet, the appearance of the watch face itself often has the most immediate visual impact.

This has led some innovators to make a watch changeable in appearance by having interchangeable watch faces. Numerous prior art patents, namely U.S. Pat. No. 4,660,992 to Paul et al., U.S. Pat. No. 4,796,240 to Stevens, U.S. Pat. No. 5,008,869 to Dweck, U.S. Pat. No. 5,018,118 to Ross, U.S. Pat. No. 5,168,479 to Lima, U.S. Pat. No. 5,787,055 to Alpert, U.S. Pat. No. 5,793,710 to Jacobi, and U.S. Pat. No. 6,118,735 to Li disclose watches with removable watch faces. One common feature and drawback with these prior art watches, is that when the watch housing is opened to allow access to the watch face, the hour, minute and second hands become exposed, and since they are very fragile there is a great likelihood that they will be damaged by anyone who is not a professional watchmaker working in a controlled environment. Thus, this kind of interchangeable watch face is not suitable for consumers to change a watch face by themselves.

In the above-listed prior art is an alternate approach for interchangeable watch faces, namely, to provide an opening in the form of a slit in the side wall of the watch casing, so that a watch face can be slid out of the casing through the slit, and a replacement watch face slid into the casing via the slit. Here, the watch face would be positioned parallel to and below the plane of the hands. In this kind of arrangement, there is typically a drive shaft extending from the watch movement perpendicularly upward to and fixedly connected to the hands. This drive shaft is usually a series of three concentric tubes which are very tiny in nature. In order to use a replaceable watch face that slides in from the side, such watch face needs to have a notch extending from a peripheral edge radially inward to the center, so that the watch face can be positioned to have the notch straddle the drive shaft as it is slid into place, as seen in prior art patents, U.S. Pat. No. 4,660,992, U.S. Pat. No. 5,793,710, and U.S. Pat. No. 6,118,735.

A still further variation in structure is seen in U.S. Pat. No. 5,751,667 to Nunes, where there is an outer crystal and an inner transparent panel below the hands; however, these transparent elements are separable to gain access to the chamber below to change the golf tees or other graphic display articles, so that the hands become exposed to damage.

The present invention seeks to provide an alternative solution to the problem of establishing different appearances for a single wristwatch in a simple, convenient, inexpensive manner which is also safe from risk and damage to the hands of the watch.

SUMMARY OF THE INVENTION

It is a first object of this invention to provide a wristwatch wherein the owner of a watch can alter the basic appearance of the watch by altering the watch face in a manner which does not risk damage to the hands.

It is a further object to provide a wristwatch where a watch face is removable, and new watch faces are replaceable in a position below the hands but visible through the transparent crystal while the hands remain protected.

It is a still further object to provide a wristwatch with a removable watch face where the hands are protected by encasing the hands between a sandwich of outer transparent crystal and inner crystal above and below the hands, respectively, where said outer and inner transparent panes are secured together by an outer perimeter casing, thus forming an integral unit or cartridge. In a preferred embodiment, this casing has screw threads on the bottom outer periphery or elsewhere for engagement with mating screw threads in a casing of such wristwatch, which casing includes therein the watch movement or drive mechanism, which is typically an electric motor with an output drive mechanism.

It is an additional object of this invention of providing a wristwatch with a removable watch face where the hands are within a removable cartridge or upper housing that includes an outer transparent crystal and an inner transparent pane, with the hands secured and protected between these two transparent elements.

It is a further object to provide a wristwatch with a removable watch face where the casing, which contains the movement, includes at its top a recess to receive the watch face and to receive and hold the cartridge containing the hands and crystal, and to allow coupling of the drive shafts fixed to the hands with the movement in the casing.

Since the casing which contains the watch movement includes a laterally extending adjustment stem, the cartridge containing the hands and the outer crystal and inner glass can be attached to the housing by merely rotating it in the recess until the mating threads engage and become secured to each other. The rotation causes no interference of any parts because the drive stems simply engage with the drive shaft from the movement and are free to rotate in the lower transparent pane of the cartridge. Thereafter, the time is set by the adjustment knob.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 2 is a top plan view thereof, FIG. 3 is an exploded view in section taken along lines 3—3 in FIG. 2, FIG. 4 is a top plan view of a second embodiment of the new wristwatch, FIG. 5 is an exploded view in section taken along lines 5—5 in FIG. 4.

DETAILED DESCRIPTION OF THE PREFERRED EMBODIMENT

Figure 1:
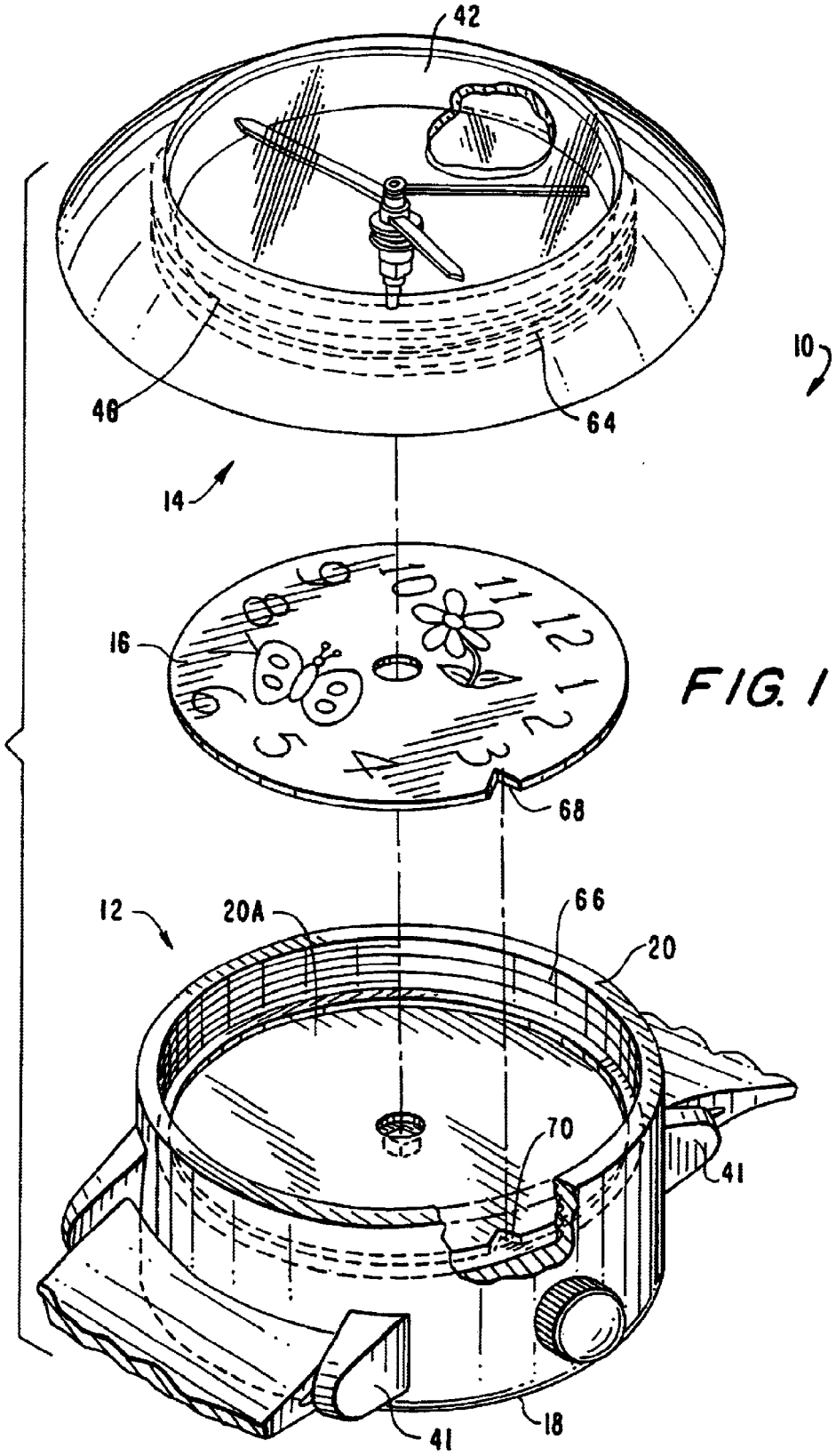
FIG. 1 is an exploded perspective view shown schematically of the new wristwatch of this invention.

FIG. 1 is a schematic drawing showing an exploded perspective view of the new wristwatch 10 of the present invention. The three basic components of this wristwatch are the casing 12, the upper housing 14 and the replaceable watch face 16. FIGS. 2, 3 and 4 show the casing 12 and upper housing in greater detail.

The casing 12 has a bottom formed by panel 18, a top part 20 including a top panel 20A, peripheral side walls 22 with a first chamber 26 defined between said top and bottom panels and said side walls. It is preferable that the casing walls define a circular cylinder with internal threads 28 on the inside wall surfaces above said top panel 20A; however, the casing outer walls may take a variety of other shapes, which are not necessarily round.

Within chamber 26 is mounted a watch movement 32 well known in the prior art which includes a motor and a replaceable battery (not shown), drive means 34 and an adjustment shaft 36 and knob 38 situated external of the side walls. The drive means includes at least two and usually three rotatable elements for rotating hour, minute and second hands respectively, such drive means also being well known in the prior art. The casing also includes typical shelf-like projections 41 on opposite ends thereof connectible to opposite ends of a wristband or bracelet.

The replaceable watch face 16 is situated atop the top panel 20A of the casing 12 with means to be described later for positioning and maintaining this or any replacement watch face in the predetermined orientation relative to the casing, to coordinate with the time indicating hands.

The upper housing 14 is formed as a removable self-contained integral unit or cartridge which can be screwed into the casing or unscrewed and removed to allow replacement of the watch face with an alternate watch face. This cartridge is formed of a transparent crystal 42 at the top, a transparent base 44 at the bottom, and side walls formed by a cylindrical rim 46 which maintains said crystal and base spaced apart to define a second chamber 48 which surrounds and protects the time indicating hands 50, 51 and 52. Situated at the center of the transparent base 44 is a bushing 54 and drive shaft means 56 comprising three concentric shafts 57, 58 and 59 corresponding and fixed to said hands 50, 51 and 52 respectively. This bushing is fixed axially in base 44 and allows the shafts 57, 58 and 59 to rotate freely therein. The shafts are typically outer and inner concentric tubes and a solid rod or additional concentric tube within said inner tube. The bottom ends of these shafts are releasably coupled to the drive elements of the drive means of the movement.

In some embodiments the drive means may extend upward above the top panel 20A; alternatively the drive means remains below 20A. At the bottom outside peripheral surface of the rim 46 are external threads 64 for threaded engagement with internal threads 66 in said casing when the upper housing 14 is joined to the casing 12 with the watch face 16 captured between them. Other coupling means without screw threads are possible for releasably securing the upper housing to the casing below.

As is evident, the watch face 16, selected by the user, is clearly visible through the crystal 42 and base 44. Because the upper housing 14 is so easily separable from the casing, watch faces can be frequently and easily interchanged. Whenever a replacement watch face is installed, its proper orientation is automatically established and maintained by notch 68 cut in a peripheral edge of the watch face engaging a projection 70 on the top surface of panel 20A the casing. Numerous other positioning means are readily possible, including a projection from the watch face into a recess in the casing, or guide surfaces of the watch face and the casing.

The transparent crystal and base of the upper housing 14 may be made of glass or plastic, and the rim or side walls 46 that maintain the crystal and base apart may be preferably metal or plastic or other material. Also, the crystal and/or the base may be configured such that their mutual peripheral edges are joined without need between them of a separate side wall or cylindrical rim component.

With the structure as disclosed above, the upper housing 14 is a fixed unit of transparent crystal, transparent base, rim, if utilized, hands and drive shafts. The hands are fully protected from contact with a person's fingers, or with the replaceable watch face or with anything. The routine for removing a watch face and substituting a new watch face is extremely simple, quick and failsafe. Obviously, there is no limit to the number of different watch faces a user can acquire and use. Furthermore, a user can easily make and/or design his or her own watch faces and graphics thereon.

FIGS. 4 and 5 illustrate a further embodiment of this invention which has many similarities to the wristwatch of FIGS. 1–3 and use the same reference numbers for components which are the same as those in FIGS. 1–3. The principal difference is that instead of a removable watch face 16 being in the form of a thin sheet situated in a thin space above panel 20A and below lower transparent base 44 in FIGS. 1–3, the changeable visual effect seen in FIGS. 4 and 5 is achieved by movable articles 72 such as tiny balls or other miniature ornamental articles dimensioned to be freely movable in space 74 above panel 20A and below transparent base 44. In this further embodiment, the visual effect of the watch face is not only changeable by substituting different movable articles while the hands remain fully protected, but the visual appearance is changeable merely by movement of the articles. Also, one could utilize both a substitute watch face and substitute movable articles within space 74 while the wristwatch is being worn.

Figure 6:
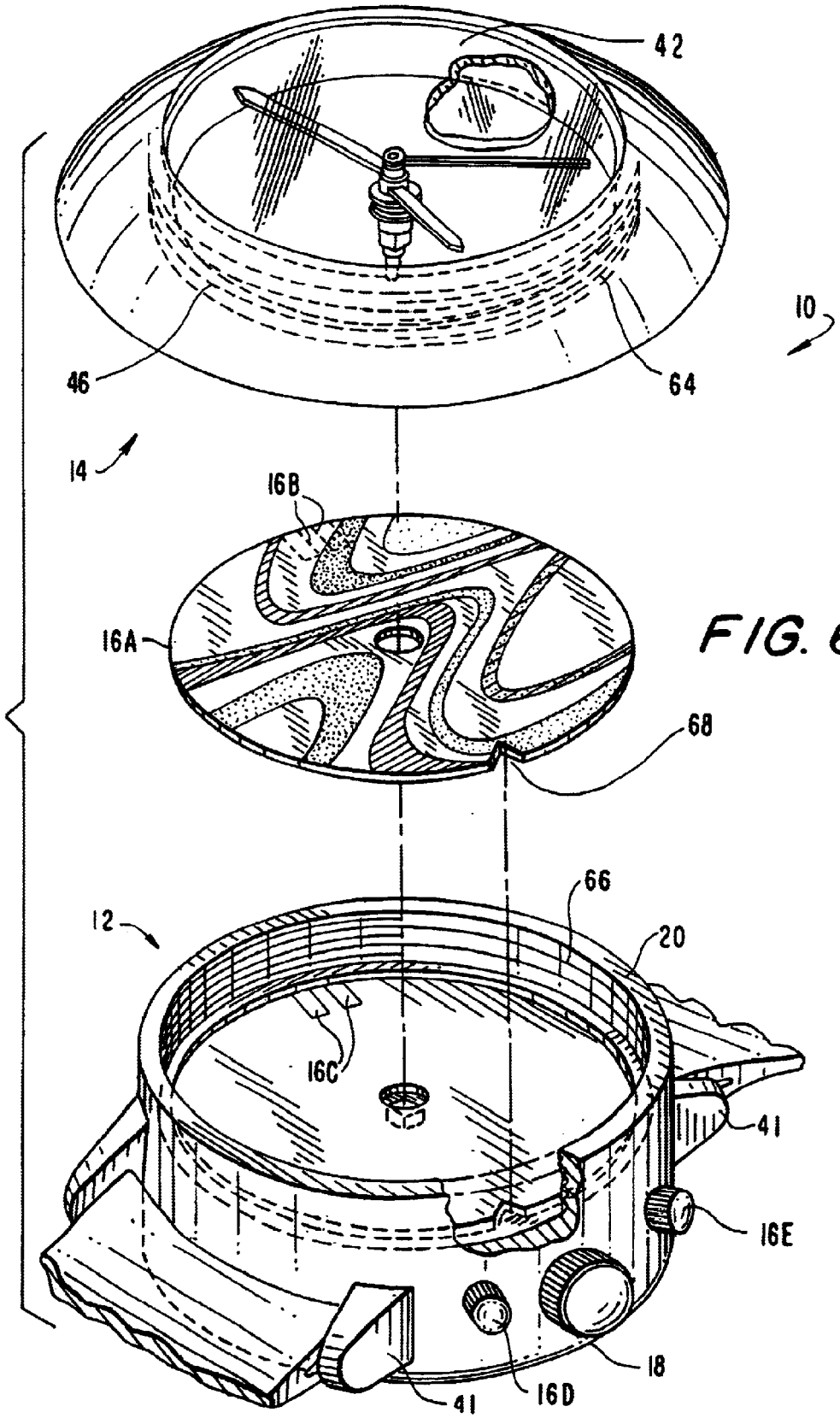
FIG. 6 is an exploded perspective view similar to FIG. 5 of a third embodiment of the new wristwatch with an electroluminescent display.

FIG. 6 shows a further embodiment of the new wristwatch, this drawing being similar to FIG. 1 and for convenience of description, having the same reference numbers for similar or identical components. The relevant difference is that the watch face 16A is an electroluminescent display ("ELD"), the technology of which is known the prior art, examples being products from (a) epartyunlimited.com at www.gotglow.com. (b) MX5Parts.co.uk at www.MX5Parts.co.uk, (c) rident Display Products at www.tridentdisplays.co.uk, and (d) All Electronics Corp., Van Nuys, Calif.

The watch face 16A using luminescent display technology provides a prescribed illuminated visual image which may change pursuant to a program or by manual control. Since the displays available in the watch face are limited to the original programming, this ELD watch face may be replaced by others with different displays, by simply separating the upper housing 14 from the lower housing or casing 12 as described earlier and substituting a different ELD watch face.

When the ELD watch face is installed its electrical contacts 16B become electrically connected to contacts 16C in the bottom of casing 12. To activate or control this ELD watch face, there are one or more control buttons 16D and 16E for on/off control and for selecting display programs. Drive and programming circuitry are included either on the ELD panel or in the casing.

It is to be understood that while certain forms of the present invention have been illustrated and described herein, it is not to be limited to the specific forms or arrangement of parts described and shown.

I claim:

1. A wristwatch for use with a replaceable watch face, comprising:

a. a casing having a top, a bottom and sides defining a first chamber, said top of said casing having a peripheral edge, a top surface within said peripheral edge and a first aperture extending through said top surface, said top of said casing adapted to receive said replaceable watch face, b. a movement mounted in said first chamber with drive means adjacent said first aperture for rotating at least two time indicating hands, and means for adjusting said drive means, c. an upper housing formed as an integral unit, comprising:

a transparent crystal at the top, a transparent base below and spaced from said crystal with a second aperture extending through said base, side walls extending between and fixed to said crystal and said base, said crystal, base and side walls defining a second chamber, drive shaft means extending through said second aperture in said base, said drive shaft means having bottom ends and opposite top ends, and at least two time indicating hands mounted to said top ends of said drive shaft means for rotation independent of each other, said time indicating hands being within said second chamber, said upper housing being positionable atop said top of said casing with said drive means of said movement releasably coupled to said drive shaft means of said upper housing, so that said movement can cause said hands to rotate, said wristwatch further comprising coupling means for releasably securing said upper housing to said casing.

2. A wristwatch according to claim 1 wherein said upper housing is cylindrical, and said coupling means comprises mating male and female threads on said side walls of said upper housing and said top of said casing respectively.

3. A wristwatch according to claim 2 wherein said top of said casing includes upward extending cylindrical walls with internal threads thereon, and said coupling means comprises said internal threads of said casing and external threads on said upper housing.

4. A wristwatch according to claim 1 wherein said base of said upper housing comprises a generally flat disk.

5. A wristwatch according to claim 1 wherein said drive means comprises a first set of concentric shafts, and said drive shaft means comprises a second set of concentric shafts adapted to be coupled to said first set of concentric shafts.

6. A wristwatch according to claim 5 wherein said top of said casing comprises a panel through which extends said first aperture, and said drive means extends upward through said first aperture.

7. A wristwatch according to claim 1 wherein said adjusting means further comprises a shaft extending from said movement transversely to and through said side of said casing and having a terminal end outside said side, and a knob fixed on said terminal end.

8. A wristwatch according to claim 2 wherein said casing sides have inside cylindrical surfaces which include thereon internal threads, and wherein said inner housing base is cylindrical and includes external threads thereon mating with said internal threads.

9. A wristwatch according to claim 1 wherein said upper housing further comprises a bezel formed as an outward extending flange adjacent said crystal.

10. A wristwatch according to claim 9 wherein said bezel extends radially outward from said side walls of said upper housing.

11. A wristwatch according to claim 1 wherein said upper housing further comprises a tubular bushing secured in said second aperture in said base, and said drive shaft means is rotatable in said bushing and axially fixed therein.

12. A wristwatch according to claim 11 wherein said upper housing comprises three hands for indicating hour, minutes and seconds respectively, and said drive shaft means comprises a set of three concentric shafts fixed respectively to said three hands respectively, and said drive means comprises three concentric elements adapted to be coupled to said concentric shafts respectively of said drive shaft means.

13. A wristwatch according to claim 1 wherein said movement is battery operated, and comprises a replaceable battery situated in said first chamber.

14. A wristwatch according to claim 1, further comprising means for positioning and maintaining said watch face in a predetermined rotary orientation relative to said casing.

15. A wristwatch according to claim 1 wherein said removable watch face comprises a disk with an outer peripheral edge with a notch extending radially inward from said edge, and said top of said casing comprises a projection for engaging said notch to position and maintain said watch face in a predetermined rotary orientation relative to said casing.

16. A wristwatch according to claim 1 wherein said side walls of said upper housing comprise a cylinder whose top end is fixed to said crystal and whose bottom end is fixed to said base.

17. A wristwatch according to claim 1 wherein said watch face is a thin sheet bearing a graphic design on at least one surface thereof.

18. A wristwatch according to claim 1 wherein said watch face includes different graphic designs on opposite sides thereof.

19. A wristwatch for use with a replaceable watch face, comprising:

a. a casing having top and bottom parts and a movement therein, b. an upper housing formed as an integral unit, comprising:

(i) top and bottom transparent panels, (ii) drive shaft means extending through said bottom transparent panel, said drive shaft means having top and bottom ends, (iii) time indicating hands fixed to said top ends of said drive shaft means, and (iv) side walls fixed to and maintaining said top and bottom transparent panels spaced apart to define a chamber therein for enclosing said time indicating hands, and c. means for releasably securing said upper housing to said top part of said casing, with said replaceable watch face situated below said bottom transparent panel and above said casing top part, and with said bottom end of said drive shaft means releasably coupled to said movement.

20. A wristwatch comprising:

a. a casing having top and bottom parts and a movement therein, b. an upper housing formed as an integral unit, comprising:

(i) top and bottom transparent panels, (ii) drive shaft means extending through said bottom transparent panel, said drive shaft means having top and bottom ends, (iii) time indicating hands fixed to said top ends of said drive shaft means, and (iv) side walls fixed to and maintaining said top and bottom transparent panels spaced apart to define a chamber therein for enclosing said time indicating hands, c. a replaceable watch face, and d. means for releasably securing said upper housing to said top part of said casing, with said replaceable watch face situated below said bottom transparent panel and above said casing top part, and with said bottom end of said drive shaft means releasably coupled to said movement.

21. A wristwatch comprising:

a. a casing having top and bottom parts and a movement therein, b. an upper housing formed as an integral unit, comprising:

(i) top and bottom transparent panels, (ii) drive shaft means extending through said bottom transparent panel, said drive shaft means having top and bottom ends, (iii) time indicating hands fixed to said top ends of said drive shaft means, (iv) side walls fixed to and maintaining said top and bottom transparent panels spaced apart to define a chamber therein for enclosing said time indicating hands, c. a replaceable watch face, and d. means for releasably securing said upper housing to said top part of said casing, with said bottom end of said drive shaft means releasably coupled to said movement, and with a second chamber defined between said bottom transparent panel and said top part of said casing, and at least one article adapted to be situated in said second chamber and dimensioned to be freely movable therein to thereby create a changeable watch face appearance.

22. A wristwatch according to claim 21 and operable with a battery in said casing, wherein said replaceable watch face comprises an electroluminescent display (ELD) panel including electrical contacts and said casing has corresponding electrical contact, for engaging and powering those of said watch face from said battery.

23. A wristwatch according to claim 22 wherein said ELD watch face comprises drive and programming circuitry for operating said ELD watch face, and said casing has at least one externally accessible switch for controlling said ELD watch face.

24. A wristwatch according to claim 22, said casing comprises drive and programming circuitry electrically connected between said battery and said ELD panel for operating said ELD watch face.

* * * * *